United States Patent [19]

Florian

[11] 3,974,722

[45] Aug. 17, 1976

[54] METHOD OF FORMING RECESSES IN THERMOPLASTIC TRAY

[75] Inventor: John Florian, Bakersfield, Calif.

[73] Assignee: Mobil Oil Corporation, New York, N.Y.

[22] Filed: Mar. 10, 1975

[21] Appl. No.: 557,135

Related U.S. Application Data

[62] Division of Ser. No. 371,819, June 20, 1973, abandoned.

[52] U.S. Cl. ..... 83/1; 83/20; 99/425; 99/445; 229/2.5 R

[51] Int. Cl.[2] ..... B26D 3/00

[58] Field of Search ..... 83/19, 20, 1; 99/425, 99/445; 229/2.5

[56] References Cited

UNITED STATES PATENTS

| | | | |
|---|---|---|---|
| 1,439,164 | 12/1922 | Hawkins | 99/425 |
| 1,627,742 | 5/1927 | Jones | 99/445 |
| 2,375,518 | 5/1945 | Bolle | 83/19 |
| 3,013,937 | 12/1961 | Brown et al. | 83/1 UX |
| 3,155,303 | 11/1964 | Fenkel | 229/2.5 |
| 3,346,400 | 10/1967 | Roesner | 229/2.5 X |

*Primary Examiner*—Willie G. Abercrombie
*Attorney, Agent, or Firm*—Charles A. Huggett; James D. Tierney

[57] ABSTRACT

A packaging tray, especially adapted for the containment of moisture containing food products such as meat, poultry and fresh produce comprising a bottom supporting surface having a plurality of spaced apart liquid entrapping recesses. The individual recesses have a larger cross-sectional area at their base than at their top.

1 Claim, 3 Drawing Figures

METHOD OF FORMING RECESSES IN THERMOPLASTIC TRAY

This is a division of application Ser. No. 371,819, filed June 20, 1973, now abandoned.

BACKGROUND OF THE INVENTION

1. Field of the Invention

The present invention relates to packaging support trays of the type commonly employed in the retailing of prepackaged cuts of meat, poultry, fresh produce and the like. For the most part, such trays are generally characterized by having a relatively flat uninterrupted interior surface for supporting products packaged therein. Such a flat surface has proven undesirable in the packaging of commodities such as meat which contains quantities of natural juices. Such watery juices as they exude from the packaged meat products accumulate in the tray bottom area surrounding the meat as well as in the tray corners, thereby causing the package to have an unsightly and unpleasant appearance.

2. Description of the Prior Art

In the past, attempts to contain liquids which exude from poultry, meat and the like have included the placement of liquid absorbent sheets between the moisture containing product and the tray surface. In addition to the added costs involved when such absorbent sheets or pads are employed, such materials have a tendency to dehydrate the product with which they are in contact. U.S. Pat. No. 2,974,843 discloses the employment of cylindrically shaped cups in the bottom surface of pulp meat trays to entrap liquids therein. Such cups are defined in the patent as having sharply defined vertical side walls and having a diameter fixed within critical limits. U.S. Pat. No. 3,346,400 discloses plastic receptacles for holding a moisture containing food product. The receptacle or tray bottom has a plurality of individual liquid proof wells, of particular dimension, designed to entrap air and liquid when a product such as fresh meat is placed in the tray to overlie the wells. The individual wells in such trays have a uniformly constant transverse dimension (e.g. ⅛ inch in diameter) within certain fixed limits, to insure liquid entrapment therein.

Forming techniques which have been employed in the past to mold liquid entrapping recesses in a tray bottom include, in the case of molded pulp, providing a plurality of nubbins on the surface of the tray forming screen over which an aqueous slurry of pulp is drawn. In such a forming method the nubbins must be shaped so as to produce a fairly uniform cross-sectional recess in the tray bottom or a recess which is wider at its top portion than at its base, otherwise the pulp tray could not be stripped from the molding screen without damaging the tray. Methods which have been employed to produce such recesses in plastic tray structures include either "hot-punching" after the tray has been formed or providing on the heated die that forms the interior surface of the tray, embossing sections to provide recesses in the tray bottom. Again, as in the case of the pulp forming method, the recessed areas so formed must necessarily have either a generally uniform cross section or a cross section which is widest at the top in order to insure ease of removal of the tray from the heated forming members without damage. Such forming techniques necessarily limit the dimensions, and hence the volume of the liquid which may be entrapped, of the individual recesses to a cross-sectional area, throughout their entire depth, which will entrap liquids by capillary action, i.e. from about 5/32 to about 7/32 inch. Simply providing a larger cross-sectional area at the top of the recess would not achieve the desired positive liquid entrapment, but would result in juices flowing out of the recess when the tray is tilted or inverted.

SUMMARY OF THE INVENTION

Tray structures, and a method of forming such tray structures, which are characterized by having a plurality of individual liquid entrapping recesses on the bottom support surface of the tray. The method comprises the employment of cold hollow punch members to form the individual recesses. Such a forming method produces recesses having expanded diameters at their base to allow for the entrapment of increased amounts of fluid while positive fluid entrapment is not impaired by virtue of the narrow diameter of the upper portion or top of the recess.

Utilizing the cold hollow punch method of the present invention, liquid entrapping recesses may be formed in a tray support surface having a cross section profile which is wider at the base of the recess than at the recess top. Such an arrangement allows dimensioning of the individual recesses so that the upper cross sectional area is within the limits necessary to insure positive liquid entrapment by capillary action but allowing for the lower portion of the recess to be wider than such limits, thereby greatly increasing the volume of liquid each individual recess is capable of positively entrapping by capillary action.

DESCRIPTION OF SPECIFIC EMBODIMENTS

Figure 1:
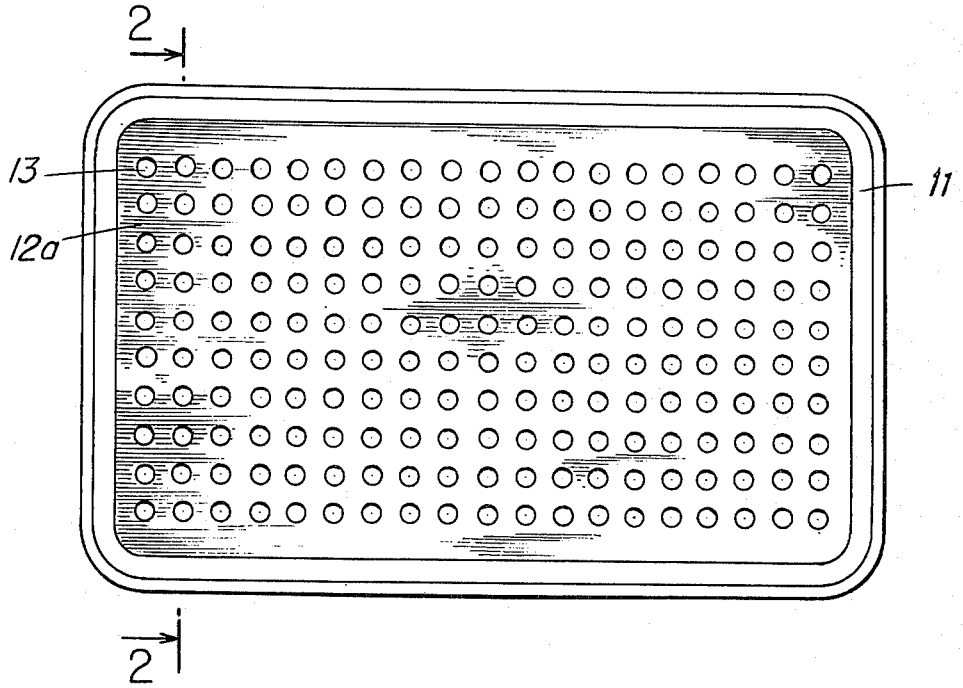
FIG. 1 is a top plan view of one form of tray structure of the present invention.

The tray structures of the present invention provide liquid entrapping recesses on their support surface capable of retaining increased amounts of liquids as compared to the prior art trays hereinbefore described. It has been found that, utilizing the recess forming method of the present invention, recesses may be formed having an upper diameter, i.e. at the liquid entrant to the recess, of such dimension to insure liquid entry and, most important, to insure that after liquid has entered the recess the upper diameter is of such dimension to insure entrapment by virtue of capillary forces and the natural surface tension of the watery fluids. Upper recess diameters within the range of from about ⅛ to ⅜ inch have been found suitable for this purpose. If the upper recess opening is too small, i.e. less than about ⅛ inch, due to surface tension characteristics of the watery fluids they tend to bridge over such a gap size without entering the recess. Conversely if the upper recess opening is too large, i.e. in excess of ⅜ inch, the liquids will not remain entrapped therein but will flow out when the tray is tilted. However, it has now been found that the dimensions of the lower portions of the recess may be expanded significantly, using the forming method hereinafter described, without altering the positive entrapment of the liquids in the recess and, simultaneously, increasing the liquid containing capacity of each individual recess. Such an arrangement allows for more complete containment of liquids and natural juices exuded by moisture containing products, especially meats and poultry, when packaged in the tray structures of the present invention.

The trays may be fabricated from a variety of materials including molded pulp and plastic. A particularly preferred material is expanded plastic foam such as, for example, polystyrene foam.

When thermoplastic foam such as polystyrene is extruded using a direct injection extrusion method, that it one where a mass of polystyrene resin is melted and mixed with a nucleating system and a blowing agent such as isopentane and freon and the mixture is subsequently extruded from a die orifice, the polystyrene foam emerging from the die is characterized by having a relatively thin skin on the exterior layers thereof. Such a skin is formed as a result of the fairly rapid cooling of the exterior surfaces of the foam thickness as it emerges from the die, as contrasted to the core or internal portion of the extrudate which cools more slowly. Such a skin is usually of a higher density than the internal core material of the sheet, since the skin essentially comprises polystyrene which has not foamed to the extent that the internal core of the sheet has foamed. When such foam material is employed in the production of the tray structures of the present invention, it has been found that a unique effect is achieved in the configuration of the liquid entrapping recesses formed when such foam is partially penetrated by an unheated, annular, hollow punch member. As the unheated, annular, hollow punch member contacts the foam skin layer it depresses (i.e. deflects downwardly) the skin layer to a point where it is finally penetrated as the hollow punch member continues its downward movement to compress the foam sheet. The relatively lower density foam material, beneath the skin layer, is progressively crushed down to a point terminating short of complete penetration of the foam layer by the punch member. Following removal of the punch element from the foam material an annular recess is left in the foam layer characterized by having an expanded diameter at its bottom as contrasted to a relatively smaller diameter opening located at the top of the recess.

Figure 2:
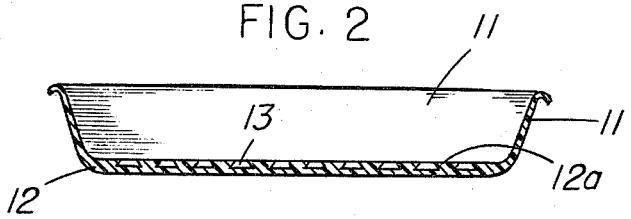
FIG. 2 is a cross-sectional view along the line 2—2 of FIG. 1.

As illustrated in the drawings, and particularly in FIGS. 1 and 2 thereof, the food container is accordance with the present invention comprises a bottom well 12 surrounded by integrally formed upstanding side wall members 11. The upper surface 12*a* of the tray bottom wall 12 is characterized by having a plurality of liquid entrapping recesses 13 which, as more clearly seen in the cross-sectional view shown in FIG. 2, are characterized by having lower surfaces 14 which have a greater cross-sectional area than the top 15 of the recess.

As hereinbefore described, such a configuration of recess 13 allows for a more complete containment of liquids and natural juices exuded by moisture containing products packaged in such trays. The increased surface area 14 of the bottom of recess 13 allows for the containment of increased amounts of liquids which may be held in recess 13 by virtue of capillary action since the diameter of the upper portion of the recess 15 remains small enough, i.e., from about 125 mils up to about 218 mils, to insure that liquids which flow into recess 13 will be trapped therein. The diameter of the base 14 of recess 13 may vary from about 156 mils up to about 312 mils without effecting the liquid retaining capabilities of recesses 13.

Another obvious advantage of the configuration of recesses 13 is that it increases the amount of product support surface area available on the tray bottom surface 12*a* while still providing for increased liquid entrapping capacity.

Figure 3:
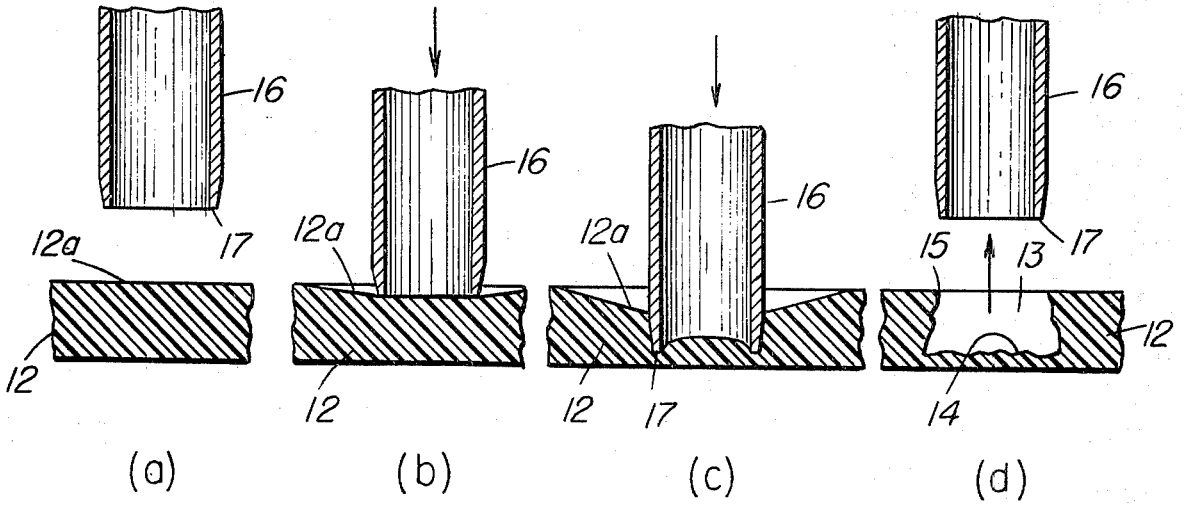
FIGS. 3*a*, *b*, *c* and *d* is a fragmentary, schematic illustration of the recess forming sequence of the method of the present invention.

The method employed to produce the specially profiled recess 13, in accord with the present invention, is schematically illustrated in FIGS. 3*a*, *b*, *c* and *d*. As illustrated in FIG. 3*a*, cold, hollow, annular punch member 16 having a tapered penetrating edge 17 is positioned above a portion of the surface 12*a* of the tray bottom wall 12. As punch element 16 is brought into contact with the foam layer 12 it causes surface 12*a* to be compressed downwardly as shown in FIG. 3*b*. As hollow punch member 16 continues its downward motion, as illustrated in FIG. 3*c*, it penetrates through depressed surface 12*a* and compresses, by rupturing and crushing, the cell structure of the foam material within the confines of the annular periphery of penetrating edge 17. As shown in FIG. 3*c*, the punch member 16 does not completely penetrate through foam layer 12. During compression and penetration of the foam layer 12 by punch member 16, by virtue of the compression and depression of surface layer 12*a*, a progressively widening diameter of the foam material is permanently compressed and crushed by hollow punch member 16. This is illustrated more clearly in FIG. 3*d*, which shows that, after removal of hollow punch element 16 from foam layer 12, a recess 13 has been formed having a wider base 14 than upper portion 15.

EXAMPLE I

A continuous length of polystyrene foam sheet, produced in accordance with the method described in U.S. Pat. No. 3,444, 283, was passed through an enclosed preheater oven. The oven was maintained at a temperature of from about 550° to about 600°F by banks of Calrod heater elements positioned above and below the advancing foam sheet. The thickness of the foam sheeting as it entered the oven was approximately 90 mils and expansion of the sheet resulting from its passage through the preheat oven resulted in a sheet thickness of about 270 mils as it emerged from the oven. The temperature of the foam sheeting as it emerged from the oven was about 325°F. Immediately adjacent the preheat oven are a pair of matched metal (aluminum) tray forming molds. As the preheated sheet passes between the male and female forming mold elements its forward motion is stopped momentarily as the mold elements cycle together to form the tray structure. As the mold opens the sheet continues its forward motion and thereafter the tray forming cycle is again repeated as successive lengths of sheet material are formed into tray structures. Before the individual tray structures are trimmed from the foam polystyrene sheet they are passed through a punching station whereat, utilizing the hollow cold punch members hereinafter described, the liquid retaining recesses are formed on the interior surface of the tray bottom.

The specific hollow punch elements used were hollow, annular metallic members having an internal diameter of 0.125 inches and an external diameter of 0.156 inches. The wall thickness of the penetrating end of the punch is tapered to a penetrating edge thickness of 0.005 inches.

A plurality of the aforedescribed punches were mounted in a rectangular arrangement and projecting from the surface of a metallic block support member. As the formed tray passed beneath the "punching block" it was momentarily halted and the block cycled into contact with the tray causing the hollow punch elements mounted on the block to partially penetrate the bottom surface of the tray thereby forming liquid entrapping recesses therein. Afterwards, the block was recycled out of contact with the tray element. The individual recesses thereby formed were characterized by having a diameter at the base of the recesses of approximately 187 mils and a diameter at the recess top of about 156 mils. The trays had a bottom wall thickness, before punching, of about 125 mils. The hollow punch elements penetrated into the tray bottom area to a depth of approximately 95 mils. Following the aforedescribed recesses forming operation, individual trays were trimmed from the continuous length of polystyrene foam sheet.

The tray structures formed in accordance with Example 1, were used as support trays for the packaging of fresh meats. The trays were found to have excellent liquid retaining capacity by virtue of their novel liquid recess configuration.

Although the configuration of recesses 13 as shown in the accompanying drawings is essentially frustoconical, this shape is a result of the annular or circular configuration of the penetrating edge 17 of hollow, cylindrical punch member 16. It is to be understood that other configurations of recesses are within the scope of the present invention such as triangular, square, oval and the like, the recess configuration being controlled by the wide variety of cross-sectional shapes of the hollow punch member which may be employed in the recess forming operation.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

I claim:

1. A method for the formation of a liquid retaining recess in the bottom support surface of a foamed thermoplastic food tray which comprises, sequentially, (a) compressing said surface with a hollow punch member; (b) penetrating said compressed surface with said punch thereby forming a permanent recess in said surface and (c) removing said punch member from said recess, said recess being characterized by having a greater cross-sectional area at its base portion than at its top portion.

* * * * *